US011594209B2

(12) United States Patent
Wang et al.

(10) Patent No.: US 11,594,209 B2
(45) Date of Patent: Feb. 28, 2023

(54) ACTIVE NOISE CONTROL DEVICE

(71) Applicant: HONDA MOTOR CO., LTD., Tokyo (JP)

(72) Inventors: Xun Wang, Wako (JP); Toshio Inoue, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 17/678,970

(22) Filed: Feb. 23, 2022

(65) Prior Publication Data

US 2022/0301538 A1 Sep. 22, 2022

(30) Foreign Application Priority Data

Mar. 18, 2021 (JP) ..... 2021-044988

(51) Int. Cl.
*G10K 11/178* (2006.01)

(52) U.S. Cl.
CPC .. *G10K 11/17854* (2018.01); *G10K 11/17817* (2018.01); *G10K 11/17823* (2018.01); *G10K 11/17825* (2018.01); *G10K 11/17879* (2018.01); *G10K 2210/1282* (2013.01); *G10K 2210/3026* (2013.01); *G10K 2210/3027* (2013.01); *G10K 2210/3028* (2013.01)

(58) Field of Classification Search
CPC ..... G10K 11/17854; G10K 11/17823; G10K 11/17879; G10K 11/17825; G10K 11/17817; G10K 2210/1282; G10K 2210/3026; G10K 2210/3027; G10K 2210/3028
USPC ..... 381/71.11
See application file for complete search history.

(56) References Cited

U.S. PATENT DOCUMENTS

| | | | | |
|---|---|---|---|---|
| 5,627,747 A * | 5/1997 | Melton | ..... | G10K 11/17821 700/83 |
| 2010/0034398 A1* | 2/2010 | Odent | ..... | G10K 11/17854 381/71.11 |
| 2021/0304725 A1* | 9/2021 | Kannan | ..... | G10K 11/17837 |
| 2022/0189451 A1* | 6/2022 | Rui | ..... | G10K 11/17857 |

FOREIGN PATENT DOCUMENTS

| | | |
|---|---|---|
| EP | 1 772 852 A1 | 4/2007 |
| JP | 2007-025527 A | 2/2007 |

* cited by examiner

*Primary Examiner* — Paul Kim
*Assistant Examiner* — Douglas J Suthers
(74) *Attorney, Agent, or Firm* — Carrier Shende & Associates, P.C.; Joseph P. Carrier; Fulchand P. Shende

(57) ABSTRACT

A cooperative control unit is configured to cause a muffled sound control signal processing unit to start feedforward signal processing, and set, when a secondary path filter has converged, a narrow band noise control signal processing unit to the converged secondary path filter and cause the narrow band noise control signal processing unit to start feedback signal processing.

8 Claims, 12 Drawing Sheets

FIG. 8

26

| FREQUENCY | INITIAL VALUE |
|---|---|
| f0 | Cff^(f0)_i, C0^(f0)_i, C1^(f0)_i |
| f1 | Cff^(f1)_i, C0^(f1)_i, C1^(f1)_i |
| ⋮ | ⋮ |
| fx | Cff^(fx)_i, C0^(fx)_i, C1^(fx)_i |
| ⋮ | ⋮ |
| fm | Cff^(fm)_i, C0^(fm)_i, C1^(fm)_i |

FIG. 9

28

| FREQUENCY | UPDATE VALUE |
|---|---|
| f0 | Cff^(f0)_u, C0^(f0)_u, C1^(f0)_u |
| f1 | Cff^(f1)_u, C0^(f1)_u, C1^(f1)_u |
| ⋮ | ⋮ |
| fx | Cff^(fx)_u, C0^(fx)_u, C1^(fx)_u |
| ⋮ | ⋮ |
| fm | Cff^(fm)_u, C0^(fm)_u, C1^(fm)_u |

ACTIVE NOISE CONTROL DEVICE

CROSS-REFERENCE TO RELATED APPLICATIONS

This application is based upon and claims the benefit of priority from Japanese Patent Application No. 2021-044988 filed on Mar. 18, 2021, the contents of which are incorporated herein by reference.

BACKGROUND OF THE INVENTION

Field of the Invention

The present invention relates to an active noise control device.

Description of the Related Art

JP 2007-025527 A discloses an active noise reduction device. The active noise reduction device controls a speaker to output an interference sound for reducing a sound pressure of noise such as road noise. The active noise reduction device controls a speaker based on a signal from a microphone placed at a position where it is desired to reduce the sound pressure of noise.

SUMMARY OF THE INVENTION

In the active noise control device disclosed in JP 2007-025527 A, a transfer characteristic used when generating a signal for controlling a speaker is fixed. The transfer characteristic is a transfer characteristic of sound between the speaker and the microphone. Therefore, when the actual transfer characteristic changes between the speaker and the microphone, the speaker cannot output an interference sound that reduces the sound pressure of the noise. There is concern that the sound pressure of noise cannot be reduced.

An object of the present invention is to solve the above-described problems.

According to an aspect of the present invention, an active noise control device performs active noise control for controlling a speaker based on an error signal output from a detector that detects, at a control point, a synthetic sound of noise transmitted from a vibration source and a canceling sound output from the speaker to cancel the noise, and the active noise control device includes a feedforward signal processing unit configured to perform feedforward signal processing for outputting a feedforward control signal in order to control the speaker based on a vibration frequency of the vibration source, a feedback signal processing unit configured to perform feedback signal processing for outputting a feedback control signal in order to control the speaker based on a component of the error signal in a frequency band centered on a predetermined frequency, and a cooperative control unit configured to perform cooperative control between the feedforward signal processing unit and the feedback signal processing unit, the feedforward signal processing unit includes a feedforward secondary path filter updating unit configured to update sequentially and adaptively a feedforward secondary path filter that is a filter related to a sound transfer characteristic from the speaker to the detector, the feedback signal processing unit includes a feedback secondary path filter signal processing unit configured to perform signal processing using a feedback secondary path filter that is a filter related to the sound transfer characteristic from the speaker to the detector, and the cooperative control unit is configured to cause the feedforward signal processing unit to start the feedforward signal processing, and set, when the feedforward secondary path filter has converged, the feedback secondary path filter to the converged feedforward secondary path filter, and cause the feedback signal processing unit to start the feedback signal processing.

The active noise control device according to the present invention can reduce the sound pressure of noise even if the transmission characteristic changes.

The above and other objects, features, and advantages of the present invention will become more apparent from the following description when taken in conjunction with the accompanying drawings, in which a preferred embodiment of the present invention is shown by way of illustrative example.

BRIEF DESCRIPTION OF THE DRAWINGS

FIG. 8 is a schematic diagram illustrating an initial value table;

FIG. 9 is a schematic diagram of an update value table;

DESCRIPTION OF THE INVENTION

First Embodiment

Figure 1:
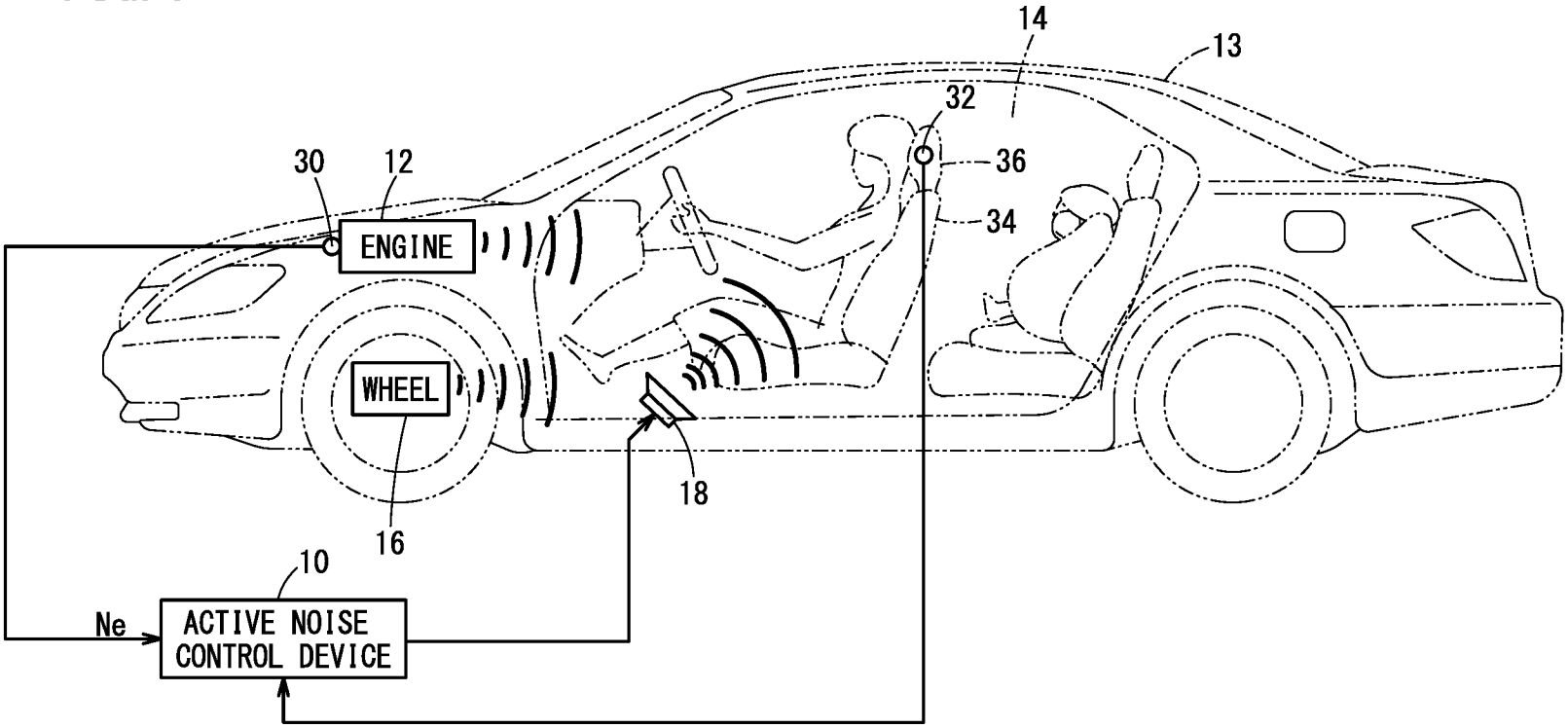
FIG. 1 is a diagram illustrating an outline of active noise control executed by an active noise control device.

FIG. 1 is a diagram illustrating an overview of active noise control executed by an active noise control device 10.

As an engine 12 runs or a propeller shaft rotates while a vehicle is running, periodic noise called muffled sound of an engine is generated in a vehicle compartment 14 of a vehicle 13. In addition, a wheel 16 vibrates due to force received from the road surface during travelling of the vehicle, and this vibration is transmitted to the vehicle body via the suspension, and road noise is generated in the vehicle compartment 14. In particular, the road noise has a peak at 40 to 50 Hz excited by an acoustic resonance characteristic of a closed space such as the vehicle compartment 14. Narrow band components with a constant bandwidth around the peak frequency produce a roaring sound, also called drumming noise, which is likely to cause discomfort to a vehicle occupant.

The active noise control device 10 according to the present embodiment reduces the sound pressure of the muffled noise of the engine and the drumming noise at a the control point in the vehicle compartment 14 by outputting the canceling sound from a speaker 18 provided in the vehicle compartment 14.

Figure 2:
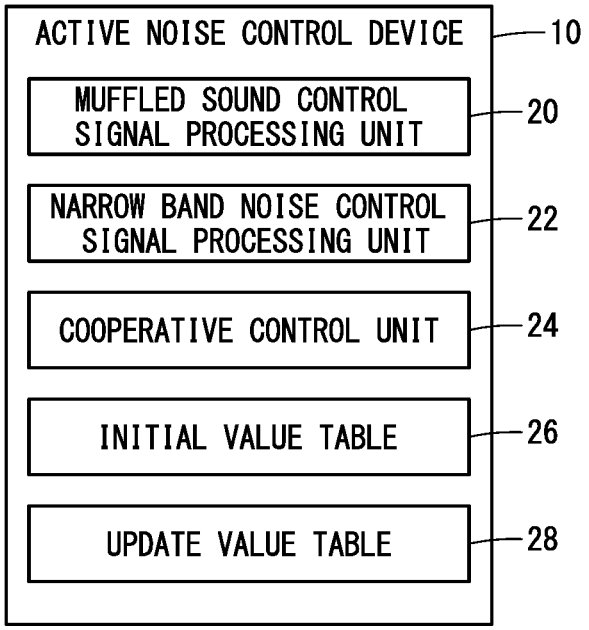
FIG. 2 is a schematic diagram illustrating a configuration of an active noise control device.

FIG. 2 is a schematic diagram illustrating a configuration of the active noise control device 10. The active noise control device 10 includes a muffled sound control signal processing unit 20, a narrow band noise control signal processing unit 22, a cooperative control unit 24, an initial value table 26, and an update value table 28.

Figure 3:
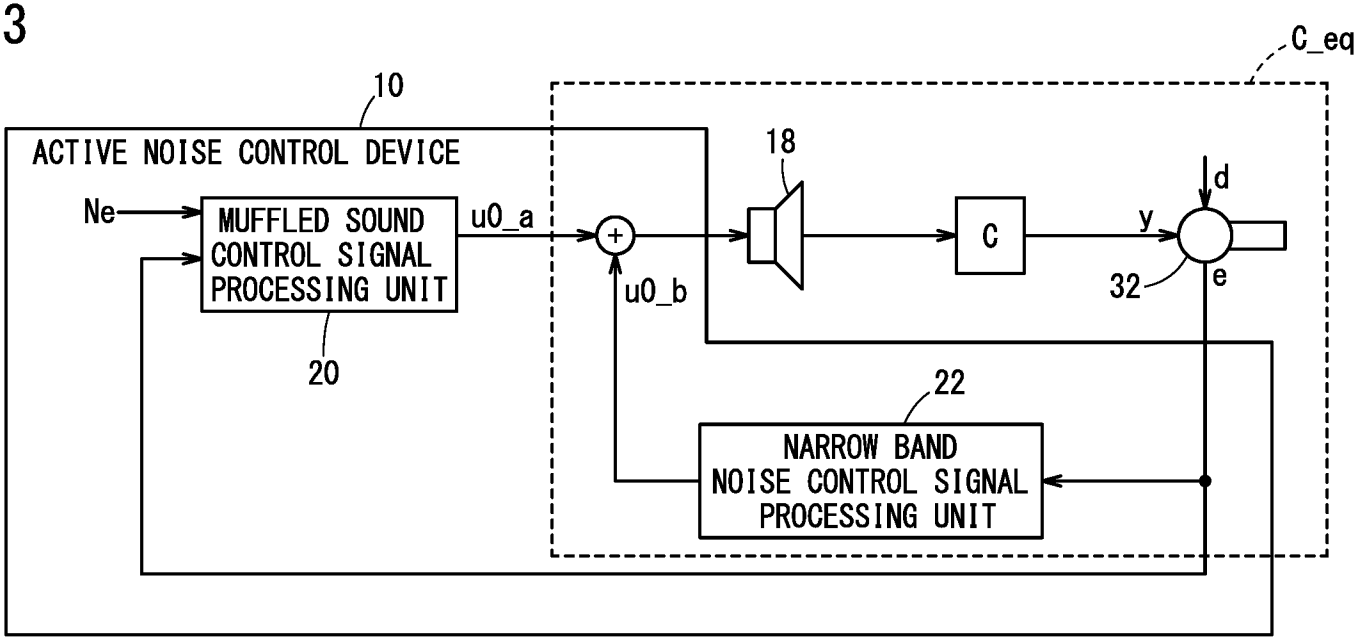
FIG. 3 is a control block diagram of a muffled sound control signal processing unit and a narrow band noise control signal processing unit.

FIG. 3 is a control block diagram of the muffled sound control signal processing unit 20 and the narrow band noise control signal processing unit 22.

The muffled sound control signal processing unit 20 performs feedforward signal processing. The feedforward signal processing generates a FF control signal u0_*a* for causing the speaker 18 to output a canceling sound that cancels the muffled sound of the engine. The FF control signal u0_*a* is generated based on an engine rotational speed Ne detected by an engine rotational speed sensor 30 (FIG. 1). The muffled sound control signal processing unit 20 corresponds to a feedforward signal processing unit according to the present invention.

The narrow band noise control signal processing unit 22 performs feedback signal processing. The feedback signal processing generates a FB control signal u0_*b* for causing the speaker 18 to output a canceling sound that cancels the drumming noise. The FB control signal u0_*b* is generated based on an error signal e output from a microphone 32 provided at a control point. The narrow band noise control signal processing unit 22 corresponds to a feedback signal processing unit of the present invention.

In this embodiment, the microphone 32 is provided on a headrest 36 of a seat 34 in the vehicle compartment 14 as shown in FIG. 1, in order to set the control point to be in the vicinity of the ears of the vehicle occupant. A synthetic sound of the noise d at the control point and the canceling sound y at the control point is input to the microphone 32. The microphone 32 outputs an error signal e.

Returning to FIG. 2, the cooperative control unit 24 performs control such that updating of a secondary path filter Cˆ, which will be described later, is performed in cooperation between the muffled sound control signal processing unit 20 and the narrow band noise control signal processing unit 22. The updating of the secondary path filter Cˆ will be described later in detail.

The initial value table 26 is a memory area in table form provided in a storage unit described later. The initial value table 26 stores initial values for the secondary path filter Cˆ. The update value table 28 is a memory area in table form provided in the storage unit. The update value table 28 stores update values for the secondary path filter Cˆ.

The active noise control device 10 includes a computation unit and the storage unit (not shown). The computation unit realizes the muffled sound control signal processing unit 20, the narrow band noise control signal processing unit 22, and the cooperative control unit 24 described above.

The computation unit may be configured by a processor such as a CPU (Central Processing Unit) or a GPU (Graphics Processing Unit).

The computation unit includes a determination unit and a control unit which are not illustrated. The determination unit and the control unit are realized by the computation unit executing a program stored in the storage unit.

At least a part of the determination unit and the control unit may be realized by an integrated circuit such as an ASIC (Application Specific Integrated Circuit) or an FPGA (Field-Programmable Gate Array). In addition, at least a part of the determination unit and the control unit may be configured by an electronic circuit including a discrete device.

The storage unit can be configured by a volatile memory (not illustrated) and a nonvolatile memory (not illustrated). Examples of the volatile memory may include, for example, a RAM (Random Access Memory) or the like. Examples of the nonvolatile memory may include, for example, a ROM (Read Only Memory), a flash memory, or the like. Data or the like may be stored, for example, in the volatile memory. Programs, tables, maps, and the like are stored, for example, in the nonvolatile memory. At least a part of the storage unit may be provided in the processor, the integrated circuit, or the like as described above.

[Configuration of Muffled Sound Control Signal Processing Unit]

Figure 4:
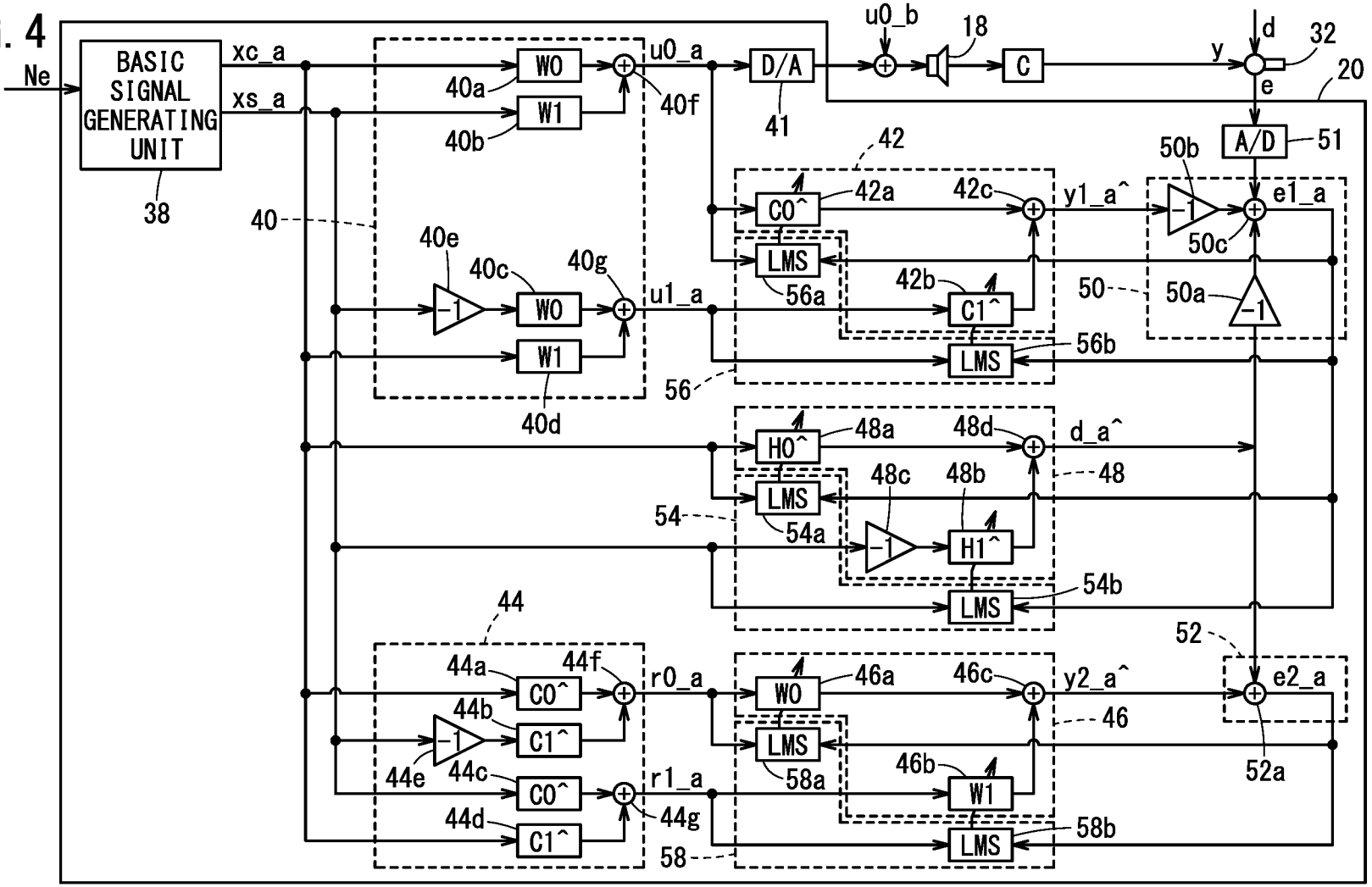
FIG. 4 is a control block diagram of the muffled sound control signal processing unit.

FIG. 4 is a control block diagram of the muffled sound control signal processing unit 20. Hereinafter, a sound transfer path from the engine 12 to the microphone 32 is referred to as a primary path. In addition, a sound transfer path from the speaker 18 to the microphone 32 is referred to as a secondary path.

The muffled sound control signal processing unit 20 includes a basic signal generating unit 38, a control signal generating unit 40, a first estimated canceling sound signal generating unit 42, a reference signal generating unit 44, a second estimated canceling sound signal generating unit 46, an estimated noise signal generating unit 48, a first virtual error signal generating unit 50, a second virtual error signal generating unit 52, a primary path filter updating unit 54, a secondary path filter updating unit 56 and a control filter updating unit 58.

Figure 5:
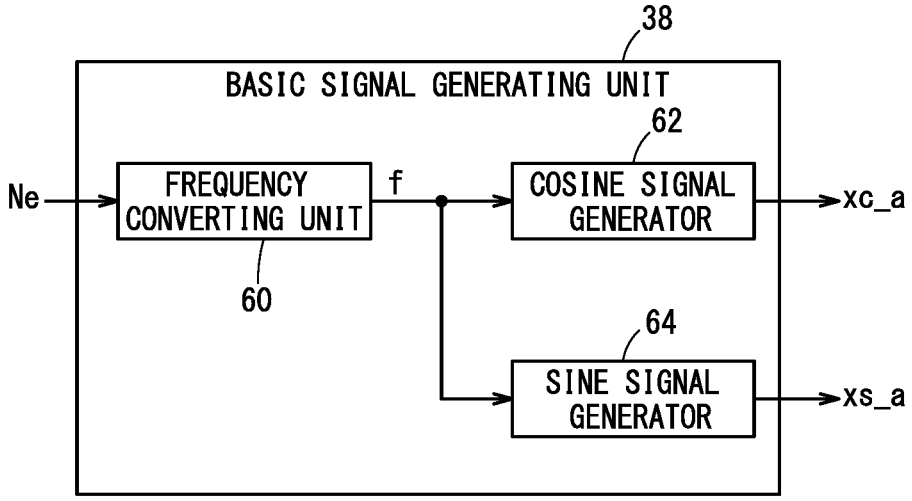
FIG. 5 is a control block diagram of a basic signal generating unit.

FIG. 5 is a control block diagram of the basic signal generating unit 38. The basic signal generating unit 38 includes a frequency converting unit 60, a cosine signal generator 62, and a sine signal generator 64.

The frequency converting unit 60 calculates the vibration frequency f of the engine 12 based on the engine rotational speed Ne. The cosine signal generator 62 generates a basic signal xc_a (=cos(2π×f×t)) which is a cosine signal of the vibration frequency f. The sine signal generator 64 generates a basic signal xs_a (=sin(2π×f×t)) which is a sine signal of the vibration frequency f. Here, t denotes time.

Returning to FIG. 4, the control signal generating unit 40 generates the FF control signals u0_*a* and u1_*a* based on the basic signals xc_a and xs_a. The control signal generating unit 40 corresponds to a FF control signal generating unit according to the present invention.

In the control signal generating unit 40, an adaptive notch filter (for example, a SAN (Single-frequency Adaptive Notch) filter) is used as a control filter W. The control filter W is updated and optimized by the control filter updating unit 58 described later. The control filter W has a filter coefficient W0 for adjusting an amplitude of the cosine wave component of the canceling sound output from the speaker 18. The control filter W has a filter coefficient W1 for adjusting an amplitude of the sine wave component of the canceling sound output from the speaker 18.

The control signal generating unit 40 includes a first control filter 40*a*, a second control filter 40*b*, a third control filter 40*c*, a fourth control filter 40*d*, an inverting amplifier 40*e*, an adder 40*f*, and an adder 40*g*.

The first control filter 40*a* has a filter coefficient W0. The second control filter 40*b* has a filter coefficient W1. The third control filter 40*c* has the filter coefficient W0. The fourth control filter 40*d* has the filter coefficient W1.

The basic signal xc_a whose amplitude has been adjusted by the first control filter 40*a* and the basic signal xs_a whose amplitude has been adjusted by the second control filter 40*b* are added by the adder 40*f* to generate the FF control signal u0_*a*. The FF control signal u0_*a* is converted into an analog signal by a digital-to-analog converter 41 and output to the speaker 18.

The third control filter 40*c* receives the basic signal −xs_a whose polarity has been inverted by the inverting amplifier 40*e*. The basic signal −xs_a whose amplitude has been adjusted by the third control filter 40*c* and the basic signal xc_a whose amplitude has been adjusted by the fourth control filter 40*d* are added by the adder 40*g* to generate the FF control signal u1_*a*.

In the first estimated canceling sound signal generating unit 42 described below, the FF control signal u0_*a* is used as a real component, and the FF control signal u1_*a* is used as an imaginary component.

The first estimated canceling sound signal generating unit 42 generates a first estimated canceling sound signal y1_*a*ˆ on the basis of the FF control signals u0_*a* and u1_*a*.

In the first estimated canceling sound signal generating unit 42, an adaptive notch filter (for example, a SAN filter) is used as a secondary path filter Cff^^. The secondary path filter Cff^^ converges to a transfer characteristic C of sound in the secondary path by being updated by the secondary path filter updating unit 56 described later. The secondary path filter Cff^^ is indicated by Cff^^=C0ˆ+iC1ˆ using filter coefficients C0ˆ and C1ˆ. Here, i denotes an imaginary number.

The first estimated canceling sound signal generating unit 42 includes a first secondary path filter 42*a*, a second secondary path filter 42*b*, and an adder 42*c*.

The first secondary path filter 42*a* has a filter coefficient C0ˆ. The second secondary path filter 42*b* has a filter coefficient C1ˆ. The FF control signal u0_*a* whose amplitude has been adjusted by the first secondary path filter 42*a* and the FF control signal u1_*a* whose amplitude has been adjusted by the second secondary path filter 42*b* are added by the adder 42*c* to generate the first estimated canceling sound signal y1_*a*ˆ.

The reference signal generating unit 44 generates reference signals r0_*a* and r1_*a* based on the basic xc_a and xs_a. The reference signal generating unit 44 corresponds to a FF reference signal generating unit according to the present invention.

In the reference signal generating unit 44, an adaptive notch filter (for example, a SAN filter) is used as the secondary path filter Cff^^. The reference signal generating unit 44 includes a third secondary path filter 44*a*, a fourth secondary path filter 44*b*, a fifth secondary path filter 44*c*, a sixth secondary path filter 44*d*, an inverting amplifier 44*e*, an adder 44*f*, and an adder 44*g*.

The third secondary path filter 44*a* has the filter coefficient C0ˆ. The fourth secondary path filter 44*b* has the filter coefficient C1ˆ. The fifth secondary path filter 44*c* has the filter coefficient C0ˆ. The sixth secondary path filter 44*d* has the filter coefficient C1ˆ.

The fourth secondary path filter 44*b* receives the reference signal −xs_a whose polarity has been inverted by the inverting amplifier 44*e*. The basic signal xc_a whose amplitude has been adjusted by the third secondary path filter 44*a* and the basic signal −xs_a whose amplitude has been adjusted by the fourth secondary path filter 44*b* are added by the adder 44*f* to generate the reference signal r0_*a*.

The basic signal xs_a whose amplitude has been adjusted by the fifth secondary path filter 44*c* and the basic signal xc_a whose amplitude has been adjusted by the sixth secondary path filter 44*d* are added by the adder 44*g* to generate the reference signal r1_*a*.

The second estimated canceling sound signal generating unit 46 generates the second estimated canceling sound y2_*a*ˆ based on the reference signals r0_*a* and r1_*a*. The second estimated canceling sound signal generating unit 46 includes a fifth control filter 46*a*, a sixth control filter 46*b*, and an adder 46*c*. The fifth control filter 46*a* has filter the filter coefficient W0. The sixth control filter 46*b* has filter the filter coefficient W1.

The reference signal r0*a* whose amplitude has been adjusted by the fifth control filter 46*a* and the reference signal r1_*a* whose amplitude has been adjusted by the sixth control filter 46*b* are added by the adder 46*c* to generate the second estimated canceling sound signals y2_*a*ˆ.

The estimated noise signal generating unit 48 generates an estimated noise signal d_aˆ based on the basic signal xc_a and the basic signal xs_a. In the estimated noise signal generating unit 48, an adaptive notch filter (for example, a SAN filter) is used as a primary path filter Hˆ. The primary path filter Hˆ converges to a transfer characteristic H of sound in the primary path by being updated by the primary path filter updating unit 54 described later. The primary path filter Hˆ is indicated by Hˆ=H0ˆ+iH1ˆ using the filter coefficients H0ˆ and H1ˆ. Here, i denotes an imaginary number.

The estimated noise signal generating unit 48 includes a first primary path filter 48*a*, a second primary path filter 48*b*, an inverting amplifier 48*c*, and an adder 48*d*. The first primary path filter 48*a* has the filter coefficient H0ˆ. The second primary path filter 48*b* has the filter coefficients H1ˆ.

The second primary path filter 48*b* receives the basic signal −xs_a whose polarity has been inverted by the inverting amplifier 48*c*. The basic signal xc_a whose amplitude has been adjusted by the first primary path filter 48*a* and the basic signal −xs_a whose amplitude has been adjusted by the second primary path filter 48*b* are added by the adder 48*d* to generate an estimated noise signal d_aˆ.

The first virtual error signal generating unit 50 generates a first virtual error signal e1_*a* based on the error signal e, the estimated noise signal d_aˆ, and the first estimated canceling sound signal y1_*a*ˆ. The first virtual error signal generating unit 50 includes an inverting amplifier 50*a*, an inverting amplifier 50*b*, and an adder 50*c*.

The error signal e converted into a digital signal by an analog-to-digital converter 51, the estimated noise signal −d_aˆ whose polarity has been inverted by the inverting amplifier 50*a*, and the first estimated canceling sound signal −y1_*a*ˆ whose polarity has been inverted by the inverting amplifier 50*b* are added by the adder 50*c* to generate a first virtual error signal e1_*a*.

The second virtual error signal generating unit 52 generates a second virtual error signal e2_*a* based on the estimated noise signal d_aˆ and the second estimated canceling sound signals y2_*a*ˆ. The second virtual error signal generating unit 52 includes an adder 52*a*. The estimated noise signal d_aˆ and the second estimated canceling sound signal y2_*a*ˆ are added by the adder 52*a* to generate the second virtual error signal e2_*a*.

The primary path filter updating unit 54 sequentially and adaptively updates the primary path filter Hˆ by an adaptive algorithm (for example, an LMS (Least Mean Square) algorithm) so that the first virtual error signal e1_*a* is minimized.

The primary path filter updating unit 54 includes a first primary path filter coefficient updating unit 54*a* and a second primary path filter coefficient updating unit 54*b*. The first primary path filter coefficient updating unit 54*a* and the second primary path filter coefficient updating unit 54*b* update the filter coefficient H0ˆ and the filter coefficient H1ˆ based on the following expressions. In the expression, n denotes the number of time steps (time step number, n=0, 1, 2, . . . ). The active noise control device 10 performs feedforward signal processing at predetermined periods. The time step indicates the length of each period. The time step number indicates how many periods (times) the feedforward signal processing is performed, and $\mu 0_H$ and $\mu 1_H$ denote step size parameters.

$$H0^{\wedge}_{n+1}=H0^{\wedge}_{n}-\mu 0_H \times e1_a_n \times xc_a_n$$

$$H1^{\wedge}_{n+1}=H1^{\wedge}_{n}-\mu 1_H \times e1_a_n \times xs_a_n$$

The secondary path filter updating unit 56 sequentially and adaptively updates the secondary path filter Cff^^ by an adaptive algorithm (for example, an LMS algorithm) so that the first virtual error signal e1_*a* is minimized. The secondary path filter updating unit 56 updates a secondary path filter Cff^^ by using a first virtual error signal e1_*a* instead of the error signal e. The first virtual error signal e1_*a* corresponds to the error signal according to the present invention. The secondary path filter updating unit 56 corresponds to a FF secondary path filter updating unit according to the present invention.

The secondary path filter updating unit 56 includes a first secondary path filter coefficient updating unit 56*a* and a second secondary path filter coefficient updating unit 56*b*. The first secondary path filter coefficient updating unit 56*a* and the second secondary path filter coefficient updating unit 56*b* update the filter coefficient C0ˆ and the filter coefficient C1ˆ based on the following expressions. In the expressions, n denotes the time step number (n=0, 1, 2, . . . ), and $\mu 0_C$ and $\mu 1_C$ denote step size parameters. Further, C0ˆ (f)_u and C1ˆ (f)_u are filter coefficients of the update value Cff^^ (f)_u corresponding to a vibration frequency f stored in the update value table 28 described above.

$$C0^{\wedge}_{n+1}=C0^{\wedge}(f)_u-\mu 0_C \times e1_a_n \times u0_a_n$$

$$C1^{\wedge}_{n+1}=C1^{\wedge}(f)_u-\mu 1_C \times e1_a_n \times u1_a_n$$

The control filter updating unit 58 sequentially and adaptively updates the control filter W by an adaptive algorithm (for example, an LMS algorithm) so that the second virtual error signal e2_*a* is minimized. The control filter updating unit 58 updates the control filter W by using the second virtual error signal e2_*a* instead of the error signal e. The second virtual error signal e2_*a* correspond to the error signal of the present invention. The control filter updating unit 58 corresponds to a FF control filter updating unit according to the present invention.

The control filter updating unit 58 includes a first control filter coefficient updating unit 58*a* and a second control filter coefficient updating unit 58*b*. The first control filter coefficient updating unit 58*a* and the second control filter coefficient updating unit 58*b* update the filter coefficient W0 and the filter coefficient W1 based on the following expressions. In the expression, n denotes the time step number (n=0, 1, 2, . . . ), and $\mu 0_W$ and $\mu 1_W$ denote step size parameters.

$$W0_{n+1}=W0_n-\mu 0_W \times e2_a_n \times r0_a_n$$

$$W1_{n+1}=W1_n-\mu 1_W \times e2_a_n \times r1_a_n$$

[Configuration of Narrow Band Noise Control Signal Processing Unit]

Figure 6:
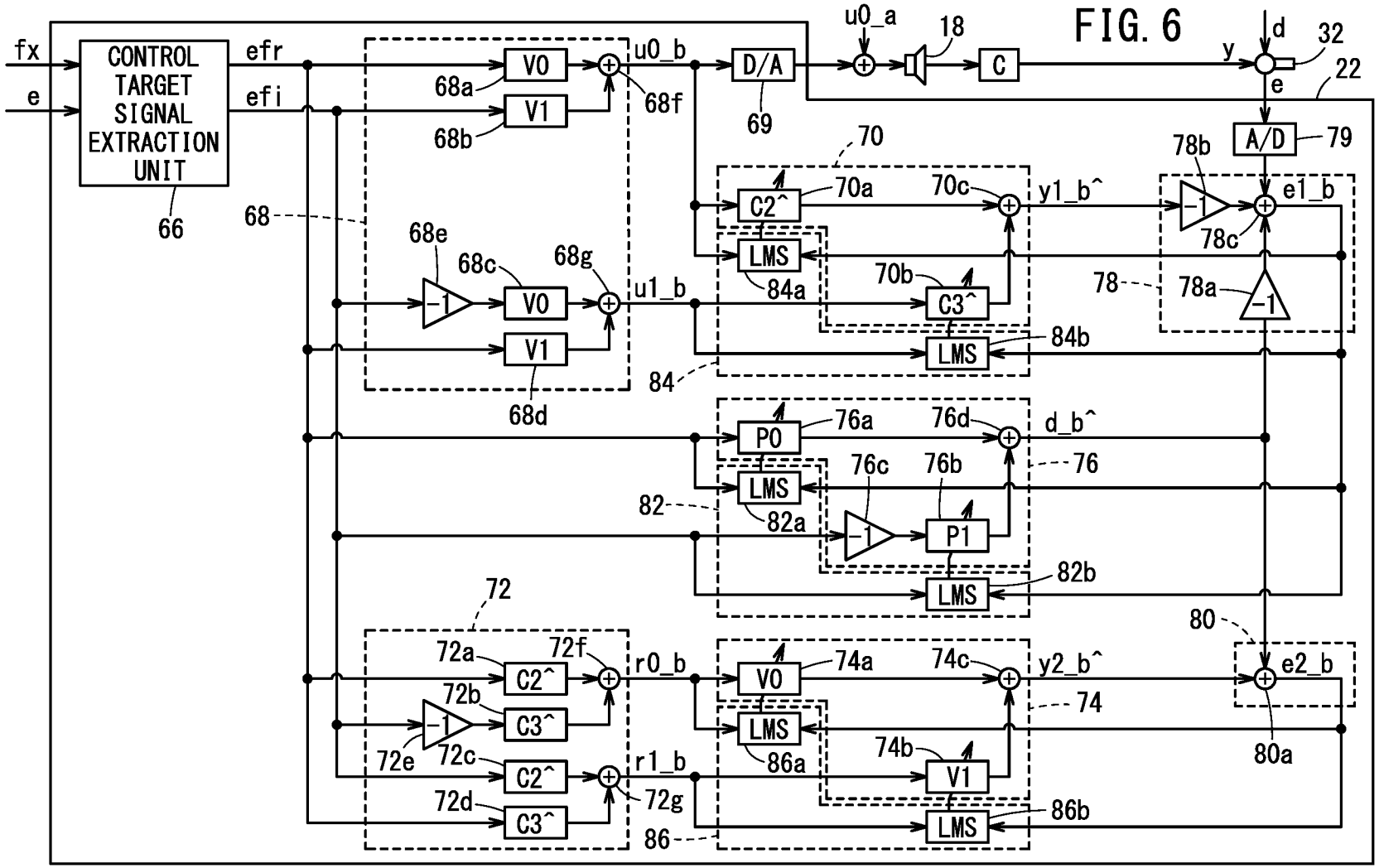
FIG. 6 is a control block diagram of the narrow band noise control signal processing unit.

FIG. 6 is a control block diagram of the narrow band noise control signal processing unit 22. The narrow band noise control signal processing unit 22 includes a control target signal extraction unit 66, a control signal generating unit 68, a first estimated canceling sound signal generating unit 70, a reference signal generating unit 72, a second estimated canceling sound signal generating unit 74, an estimated noise signal generating unit 76, a first virtual error signal generating unit 78, a second virtual error signal generating unit 80, an adjustment filter updating unit 82, a secondary path filter updating unit 84, and a control filter updating unit 86.

Figure 7:
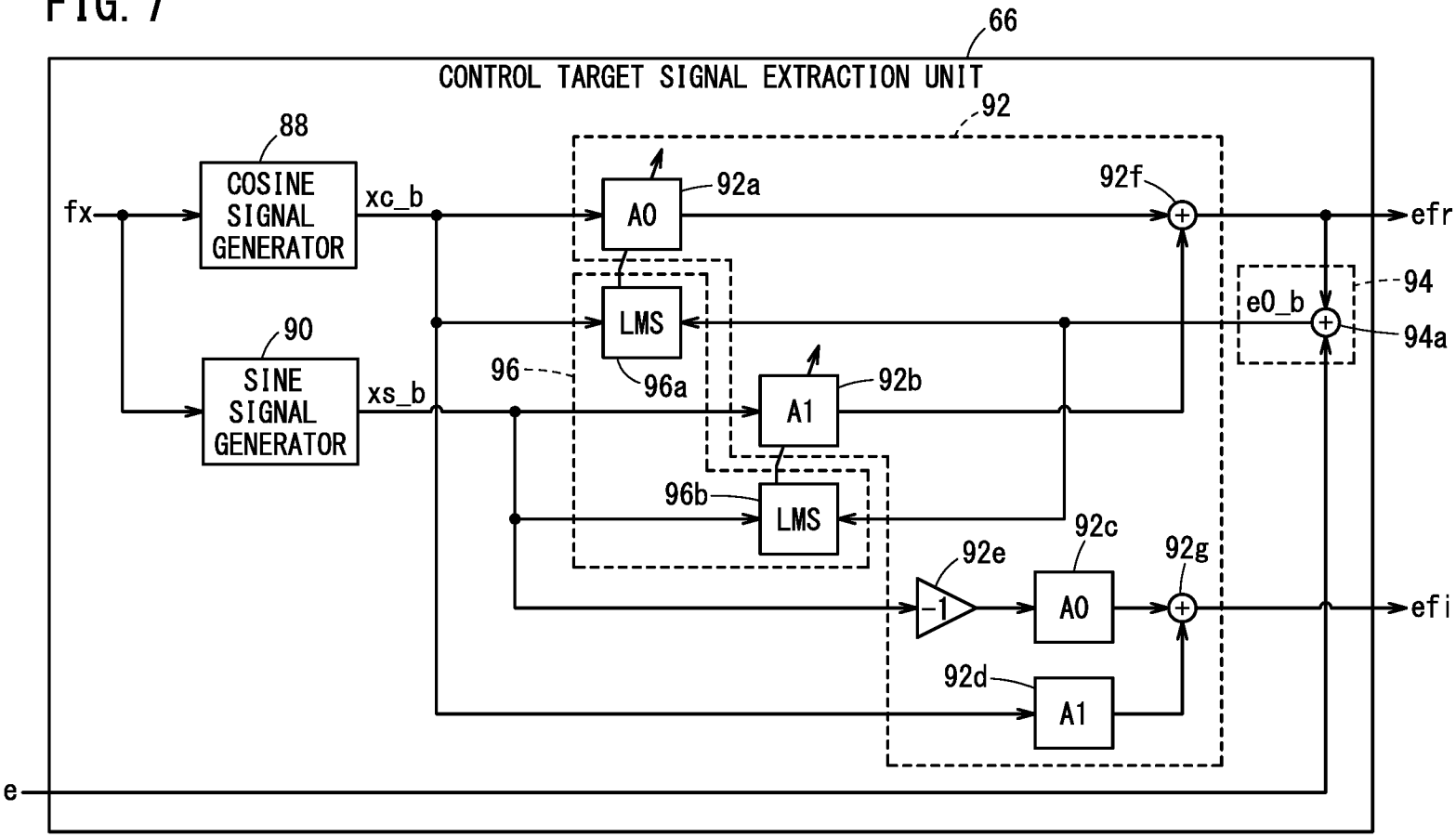
FIG. 7 is a control block diagram of the control target signal extraction unit.

FIG. 7 is a control block diagram of the control target signal extraction unit 66. The control target signal extraction unit 66 includes a cosine signal generator 88, a sine signal generator 90, an extraction signal generating unit 92, and an extraction filter updating unit 96.

The cosine signal generator 88 generates a basic signal xc_b (=cos(2π×fx×t)) which is a cosine signal of the control target frequency fx. The sine signal generator 90 generates a basic signal xs_b (=sin(2π×fx×t)) which is a sine signal of the control target frequency fx. Here, t denotes time. The control target frequency fx is different from the vibration frequency f of the muffled sound control signal processing unit 20 and is set in advance. The control target frequency fx is set near the peak frequency of the drumming noise. The control target frequency fx corresponds to a predetermined frequency in the present invention.

The extraction signal generating unit 92 generates an extraction signal efr and an extraction signal efi based on the basic xc_b and the basic signal xs_b.

In the extraction signal generating unit 92, an adaptive notch filter (for example, a SAN filter) is used as an extraction filter A. The extraction filter A is updated and optimized by the extraction filter updating unit 96 to be described later. The extraction filter A has filter coefficients A0 and A1 that match the basic signals xc_b and xs_b to the amplitude and phase of the component of the control target frequency fx included in the drumming noise.

The extraction signal generating unit 92 includes a first extraction filter 92*a*, a second extraction filter 92*b*, a third extraction filter 92*c*, a fourth extraction filter 92*d*, an inverting amplifier 92*e*, an adder 92*f*, and an adder 92*g*.

The first extraction filter 92*a* has a filter coefficient A0. The second extraction filter 92*b* has a filter coefficient A1. The third extraction filter 92*c* has the filter coefficient A0. The fourth extraction filter 92*d* has the filter coefficient A1.

The basic signal xc_b whose amplitude has been adjusted by the first extraction filter 92*a* and the basic signal xs_b whose amplitude has been adjusted by the second extraction filter 92*b* are added by the adder 92*f* to generate extraction signal efr.

The basic signal −xs_b whose polarity has been inverted by the inverting amplifier 92*e* is input to the third extraction filter 92*c*. The basic signal −xs_b whose amplitude has been adjusted by the third extraction filter 92*c* and the basic signal xc_b whose amplitude has been adjusted by the fourth extraction filter 92*d* are added by the adder 92*g* to generate the extraction signal efi.

A differential signal generating unit 94 generates a differential signal e0_*b* based on the error signal e and the extraction signal efr. The differential signal generating unit 94 includes an adder 94*a*. The error signal e and the extraction signal efr are added by the adder 94*a* to generate the differential signal e0_*b*.

The extraction filter updating unit 96 sequentially and adaptively updates the extraction filter A using an adaptive algorithm (for example, an LMS algorithm) so that the differential signal e0_*b* is minimized.

The extraction filter updating unit 96 includes a first extraction filter coefficient updating unit 96*a* and a second extraction filter coefficient updating unit 96*b*. The first extraction filter coefficient updating unit 96*a* and the second extraction filter coefficient updating unit 96*b* update the filter coefficient A0 and the filter coefficient A1 based on the following expressions. In the expressions, m denotes the time step number (m=0, 1, 2, . . . ). The active noise control device 10 performs feedback signal processing at predetermined periods. The time step indicates the length of each period. The time step number indicates how many periods (times) the feedback signal processing is performed, and $\mu 0_A$ and $\mu 1_A$ denote step size parameters.

$$A0_{m+1}=A0_m-\mu 0_A \times e0_b_m \times xc_b_m$$

$$A1_{m+1}=A1_m-\mu 1_A \times e0_b_m \times xs_b_m$$

Returning to FIG. 6, the control signal generating unit 68 generates the FB control signals u0_*b* and u1_*b* based on the extraction signals efr and efi. The control signal generating unit 68 corresponds to a FB control signal generating unit according to the present invention.

In the control signal generating unit 68, an adaptive notch filter (for example, a SAN filter) is used as a control filter V. The control filter V is updated and optimized by the control filter updating unit 86 described later. The control filter V has a filter coefficient V0 for adjusting an amplitude of a cosine wave component and a filter coefficient V1 for adjusting an amplitude of a sine wave component of the canceling sound output from the speaker 18.

The control signal generating unit 68 includes a first control filter 68*a*, a second control filter 68*b*, a third control filter 68*c*, a fourth control filter 68*d*, an inverting amplifier 68*e*, an adder 68*f*, and an adder 68*g*.

The first control filter 68*a* has a filter coefficient V0. The second control filter 68*b* has a filter coefficient V1. The third control filter 68*c* has the filter coefficient V0. The fourth control filter 68*d* has the filter coefficient V1.

The extraction signal efr whose amplitude has been adjusted by the first control filter 68*a* and the extraction signal efi whose amplitude has been adjusted by the second control filter 68*b* are added by the adder 68*f* to generate the FB control signal u0_*b*. The FB control signal u0_*b* is converted into an analog signal by a digital-to-analog converter 69 and output to the speaker 18.

The third control filter 68*c* receives the extraction signal −efi whose polarity has been inverted by the inverting amplifier 68*e*. The extraction signal −efi whose amplitude has been adjusted by the third control filter 68*c* and the extraction signal efr whose amplitude has been adjusted by the fourth control filter 68*d* are added by the adder 68*g* to generate the FB control signals u1_*b*.

The first estimated canceling sound signal generating unit 70 generates a first estimated canceling sound signal y1_*b*ˆ on the basis of the FB control signals u0_*b* and u1_*b*.

In the first estimated canceling sound signal generating unit 70, an adaptive notch filter (for example, a SAN filter) is used as a secondary path filter Cfbˆ. The secondary path filter Cfbˆ is updated by the secondary path filter updating unit 84, which will be described later, so that the secondary path filter Cfbˆ converges to the sound transfer characteristic C in the secondary path. The secondary path filter Cfbˆ is indicated by Cfbˆ=C2ˆ+iC3ˆ using filter coefficients C2ˆ and C3ˆ. Here, i denotes an imaginary number.

The first estimated canceling sound signal generating unit 70 includes a first secondary path filter 70*a*, a second secondary path filter 70*b*, and an adder 70*c*.

The first secondary path filter 70*a* has the filter coefficient C2ˆ. The second secondary path filter 70*b* has the filter coefficient C3ˆ. The FB control signal u0_*b* whose amplitude has been adjusted by the first secondary path filter 70*a* and the FB control signal u1_*b* whose amplitude has been adjusted by the second secondary path filter 70*b* are added by the adder 70*c* to generate the first estimated canceling sound signal y1_*b*ˆ.

The reference signal generating unit 72 generates reference signals r0_*b* and r1_*b* based on the extraction signals efr and efi. The reference signal generating unit 72 corresponds to a FB secondary path filter signal processing unit according to the present invention.

In the reference signal generating unit 72, an adaptive notch filter (for example, a SAN filter) is used as a secondary path filter Cfbˆ. The reference signal generating unit 72 includes a third secondary path filter 72*a*, a fourth secondary path filter 72*b*, a fifth secondary path filter 72*c*, a sixth secondary path filter 72*d*, an inverting amplifier 72*e*, an adder 72*f*, and an adder 72*g*.

The third secondary path filter 72*a* has the filter coefficient C2ˆ. The fourth secondary path filter 72*b* has the filter coefficient C3ˆ. The fifth secondary path filter 72*c* has the filter coefficient C2ˆ. The sixth secondary path filter 72*d* has the filter coefficient C3ˆ.

The fourth secondary path filter 72*b* receives the extraction signal −efi whose polarity has been inverted by the inverting amplifier 72*e*. The extraction signal efr whose amplitude has been adjusted by the third secondary path filter 72*a* and the extraction signal −efi whose amplitude has been adjusted by the fourth secondary path filter 72*b* are added by the adder 72*f* to generate the reference signal r0_*b*.

The extraction signal efr whose amplitude has been adjusted by the fifth secondary path filter 72*c* and the extraction signal efi whose amplitude has been adjusted by the sixth secondary path filter 72*d* are added by the adder 72*g* to generate the reference signal r1_*b*.

The second estimated canceling sound signal generating unit 74 generates a second estimated canceling sound signal y2_*b* on the basis of the reference signals r0_*b* and r1_*b*. The second estimated canceling sound signal generating unit 74 includes a fifth control filter 74*a*, a sixth control filter 74*b*, and an adder 740.

The reference signal r0_*b* whose amplitude has been adjusted by the fifth control filter 74*a* and the reference signal r1_*b* whose amplitude has been adjusted by the sixth control filter 74*b* are added by the adder 74*c* to generate the second estimated canceling sound signals y2_*b*ˆ.

The estimated noise signal generating unit 76 generates an estimated noise signal d_bˆ based on the extraction signal efr and the extraction signal efi. In the estimated noise signal generating unit 76, an adaptive notch filter (for example, a SAN filter) is used as an adjustment filter P for adjusting characteristics of the extraction signal efr and the extraction signal efi. The adjustment filter P is updated by the adjustment filter updating unit 82 described later. The adjustment filter P is indicated by P=P0+iP1 using a filter coefficient P0 and a filter coefficient P1. Here, i denotes an imaginary number.

The estimated noise signal generating unit 76 includes a first adjustment filter 76*a*, a second adjustment filter 76*b*, an inverting amplifier 76*c*, and an adder 76*d*. The first adjustment filter 76*a* has the filter coefficient P0. The second adjustment filter 76*b* has the filter coefficient P1.

The second adjustment filter 76*b* receives the extraction signal −efi whose polarity has been inverted by the inverting amplifier 76*c*. The extraction signal efr whose amplitude has been adjusted by the first adjustment filter 76*a* and the extraction signal −efi whose amplitude has been adjusted by the second adjustment filter 76*b* are added by the adder 76*d* to generate the estimated noise signal d_b^.

The first virtual error signal generating unit 78 generates a first virtual error signals e1_*b* based on the error signal e, the estimated noise signal d_b^, and the first estimated canceling sound signal y1_*b*^. The first virtual error signal generating unit 78 includes an inverting amplifier 78*a*, an inverting amplifier 78*b*, and an adder 78*c*.

The error signal e converted into a digital signal by an analog-to-digital converter 79, the estimated noise signal −d_b^ whose polarity has been inverted by the inverting amplifier 78*a*, and the first estimated canceling sound signal −y1_*b*^ whose polarity has been inverted by the inverting amplifier 78*b* are added by the adder 78*c* to generate the first virtual error signal e1_*b*.

The second virtual error signal generating unit 80 generates a second virtual error signal e2_*b* based on the estimated noise signal d_b^ and the second estimated canceling sound signal y2_*b*^. The second virtual error signal generating unit 80 includes an adder 80*a*. The estimated noise signal d_b^ and the second estimated canceling sound signal y2_*b*^ are added by the adder 80*a* to generate the second virtual error signal e2_*b*.

The adjustment filter updating unit 82 sequentially and adaptively updates the adjustment filter P by an adaptive algorithm (for example, an LMS algorithm) so that the first virtual error signal e1_*b* is minimized.

The adjustment filter updating unit 82 includes a first adjustment filter coefficient updating unit 82*a* and a second adjustment filter coefficient updating unit 82*b*. The first adjustment filter coefficient updating unit 82*a* and the second adjustment filter coefficient updating unit 82*b* update the filter coefficient P0 and the filter coefficient P1 based on the following expressions. In the expressions, m denotes the time step number (m=0, 1, 2, . . . ), and $\mu 0_P$ and $\mu 1_P$ denote step size parameters $$P0_{m+1}=P0_m-\mu 0_P\times e1_b_m\times efr$$

$$P1_{m+1}=P1_m-\mu 1_P\times e1_b_m\times efi$$

The secondary path filter updating unit 84 sequentially and adaptively updates the secondary path filter Cfb^ by an adaptive algorithm (for example, an LMS algorithm) so that the first virtual error signal e1_*b* is minimized. The secondary path filter updating unit 84 updates the secondary path filter Cfb^ using the first virtual error signal e1_*b* instead of the error signal e. The first virtual error signal e1_*b* corresponds to the error signal in the present invention. The secondary path filter updating unit 84 corresponds to a FB secondary path filter updating unit according to the present invention.

The secondary path filter updating unit 84 includes a first secondary path filter coefficient updating unit 84*a* and a second secondary path filter coefficient updating unit 84*b*. The first secondary path filter coefficient updating unit 84*a* and the second secondary path filter coefficient updating unit 84*b* update a filter coefficient C2^ and a filter coefficient C3^ based on the following expressions. In the expressions, m denotes the time step number (m=0, 1, 2, . . . ), and $\mu 2_C$ and $\mu 3_C$ denote step size parameters.

$$C2\hat{}_{m+1}=C2\hat{}_m-\mu 2_C\times e1_b_m\times u0_b_m$$

$$C3\hat{}_{m+1}=C3\hat{}_m-\mu 3_C\times e1_b_m\times u1_b_m$$

The control filter updating unit 86 sequentially and adaptively updates the control filter V by an adaptive algorithm (for example, an LMS algorithm) so that the second virtual error signal e2_*b* is minimized. The control filter updating unit 86 updates the control filter V by using the second virtual error signal e2_*b* instead of the error signal e. The second virtual error signal e2_*b* corresponds to the error signal in the present invention. The control filter updating unit 86 corresponds to a FB control filter updating unit according to the present invention.

The control filter updating unit 86 includes a first control filter coefficient updating unit 86*a* and a second control filter coefficient updating unit 86*b*. The first control filter coefficient updating unit 86*a* and the second control filter coefficient updating unit 86*b* update the filter coefficient V0 and the filter coefficient V1 based on the following expressions. In the expression, m denotes the time step number (n=0, 1, 2, . . . ), and $\mu 0_V$ and $\mu 1_V$ indicate step size parameters.

$$V0_{m+1}=V0_m-\mu 0_V\times e2_b_m\times r0_b_m$$

$$V1_{m+1}=V1_m-\mu 1_V\times e2_b_m\times r1_b_m$$

[Cooperative Control]

FIG. 8 is a schematic diagram showing the initial value table 26. FIG. 9 is a schematic diagram of the update value table 28.

The initial value table 26 stores initial values for the secondary path filter Cff^^ of the muffled sound control signal processing unit 20 in association with frequencies. When the active noise control device 10 is shipped, all the initial values Cff^^(f)_i of the secondary path filter Cff^^ are set to "0". When the active noise control is started, the cooperative control unit 24 writes the initial values Cff^^(f)_i stored in the initial value table 26 into the update value table 28 as update values Cff^^(f)_u.

The vibration frequency f input to the muffled sound control signal processing unit 20 changes depending on the engine rotational speed Ne. The cooperative control unit 24 selects the update value Cff^^(f)_u corresponding to the vibration frequency f at that time from the update value table 28 for each period, and sets the secondary path filter Cff^^ of the muffled sound control signal processing unit 20 to have the update value Cff^^(f)_u. The secondary path filter updating unit 56 of the muffled sound control signal processing unit 20 updates the secondary path filter Cff^^ using the update value Cff^^(f)_u. The updated secondary path filter Cff^^ is written to the update value table 28 as an update value Cff^^(f)_u.

The control target frequency fx set by the narrow band noise control signal processing unit 22 is a fixed value determined in advance as described above. When the feedback signal processing is started, the cooperative control unit 24 selects an update value Cff^^(fx)_u corresponding to the control target frequency fx from the update value table 28, and sets the secondary path filter Cfb^ of the narrow band noise control signal processing unit 22 to have the update value Cff^^(fx)_u. That is, in the secondary path filter Cfb^ of the narrow band noise control signal processing unit 22, the filter coefficient C2^ is set to the filter coefficient C0^(fx)_u of the update value Cff^^(fx)_u, and the filter coefficient C3^ is set to the filter coefficient C1^(fx)_u of the update value Cff^^(fx)_u. Unlike the secondary path filter updating unit 56 of the muffled sound control signal processing unit 20, the secondary path filter updating unit 84 of the narrow band noise control signal processing unit 22 updates the secondary path filter Cfb^ using the secondary path filter Cfb^ updated in the previous period.

Each time the muffled sound control signal processing unit 20 updates the secondary path filter Cff^^, the cooperative control unit 24 writes the updated secondary path filter Cff^^ in the update value table 28 as an update value Cff^^(f)_u corresponding to the vibration frequency f. Further, when the active noise control ends, the cooperative control unit 24 writes the update values Cff^^(f)_u stored in the update value table 28 into the initial value table 26 as the initial values Cff^^(f)_i. However, as for the initial value Cff^^(fx)_i, the latest secondary path filter Cfb^ updated by the secondary path filter updating unit 84 of the narrow band noise control signal processing unit 22 is written over.

Figure 10:
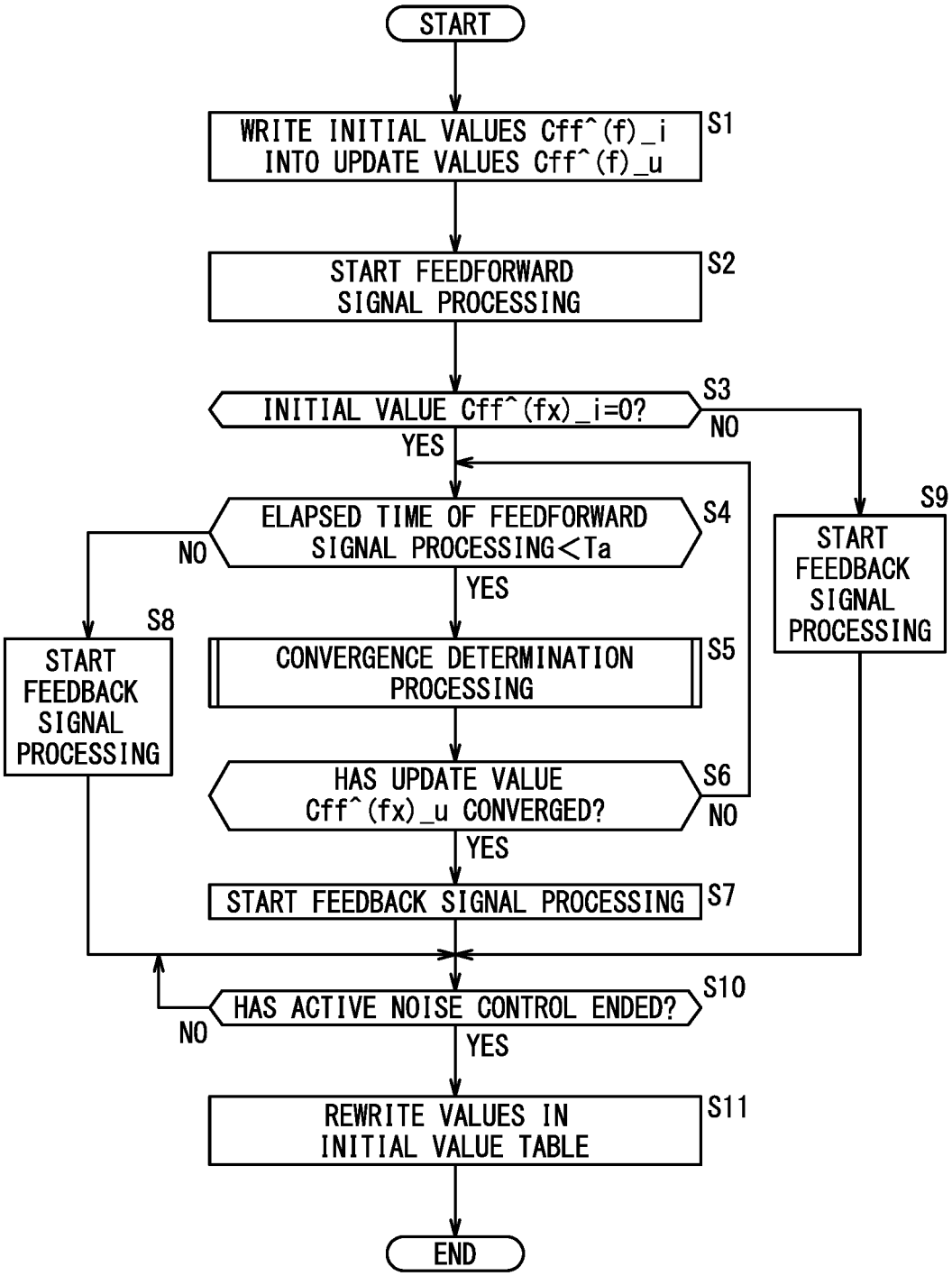
FIG. 10 is a flowchart illustrating a flow of cooperative control processing performed by a cooperative control unit.

FIG. 10 is a flowchart showing the flow of cooperative control processing performed by the cooperative control unit 24. The cooperative control process is executed each time the active noise control is started.

In step S1, the cooperative control unit 24 writes the initial values Cff^^(f)_i of the initial value table into the update values Cff^^(f)_u of the update value table 28, and proceeds to step S2.

In step S2, the cooperative control unit 24 causes the muffled sound control signal processing unit 20 to start the feedforward signal processing, and the process proceeds to step S3.

In step S3, the cooperative control unit 24 determines whether or not the initial value Cff^^(fx)_i corresponding to the control target frequency fx is "0". When the initial value Cff^^(fx)_i is "0", the process proceeds to step S4, and when the initial value Cff^^(fx)_i is not "0", the process proceeds to step S9.

In step S4, the cooperative control unit 24 determines whether or not the elapsed time from the start of the feedforward signal processing is less than a predetermined time Ta. If the elapsed time is shorter than the predetermined time Ta, the process proceeds to step S5, and if the elapsed time is equal to or longer than the predetermined time Ta, the process proceeds to step S8.

In step S5, the cooperative control unit 24 performs convergence determination processing on the update value Cff^^(fx)_u corresponding to the control target frequency fx, and proceeds to step S6. The convergence determination processing will be described later in detail.

In step S6, the cooperative control unit 24 determines whether or not the update value Cff^^(fx)_u has converged. When the update value Cff^^(fx)_u has converged, the process proceeds to step S7, and when the update value Cff^^(fx)_u has not converged, the process returns to step S4.

In step S7, the cooperative control unit 24 causes the narrow band noise control signal processing unit 22 to start the feedback signal processing, and the process proceeds to step S10. When the feedback signal processing is started in step S7, the secondary path filter Cfb^ of the narrow band noise control signal processing unit 22 is set to have the update value Cff^^(fx)_u of the update value table 28. At this time, the update value Cff^^(fx)_u has converged. As a result, the feedback signal processing can be started using the update value Cff^^(fx)_u that has been well subject to learning and converged in the feedforward signal processing.

As described above, in step S4, when the elapsed time from the start of the feedforward signal processing is equal to or longer than the predetermined time Ta, the process proceeds to step S8.

In step S8, the cooperative control unit 24 causes the narrow band noise control signal processing unit 22 to start the feedback signal processing, and the process proceeds to step S10. When the feedback signal processing is started in step S8, the secondary path filter Cfb^ of the narrow band noise control signal processing unit 22 is set to have the update value Cff^^(fx)_u of the update value table 28. At this time, the update value Cff^^(fx)_u has not converged yet. As a result, when the elapsed time from the start of the feedforward signal processing becomes equal to or longer than the predetermined time Ta, the feedback signal processing is started even if the update value Cff^^(fx)_u has not converged, and thus it is possible to reduce the sound pressure of the drumming noise.

As described above, if the initial value Cff^^(fx)_i is not "0" in step S3, the process proceeds to step S9.

In step S9, the cooperative control unit 24 causes the narrow band noise control signal processing unit 22 to start the feedback signal processing, and the process proceeds to step S10. When the feedback signal processing is started in step S9, the secondary path filter Cfb^ of the narrow band noise control signal processing unit 22 is set to have the initial value Cff^^(fx)_i of the initial value table 26.

In step S10, the cooperative control unit 24 determines whether or not the active noise control has ended. When the active noise control has ended, the process proceeds to step S11, and when the active noise control has not ended, the process of step S10 is repeated.

In step S11, the cooperative control unit 24 rewrites the initial values Cff^^(f)_i stored in the initial value table 26 to be the update values Cff^^(f)_u stored in the update value table 28, and ends the cooperative control process. However, for the initial value Cff^^(fx)_i of the initial value table 26, the latest secondary path filter Cfb^ updated by the secondary path filter updating unit 84 of the narrow band noise control signal processing unit 22 is written over.

Figure 11:
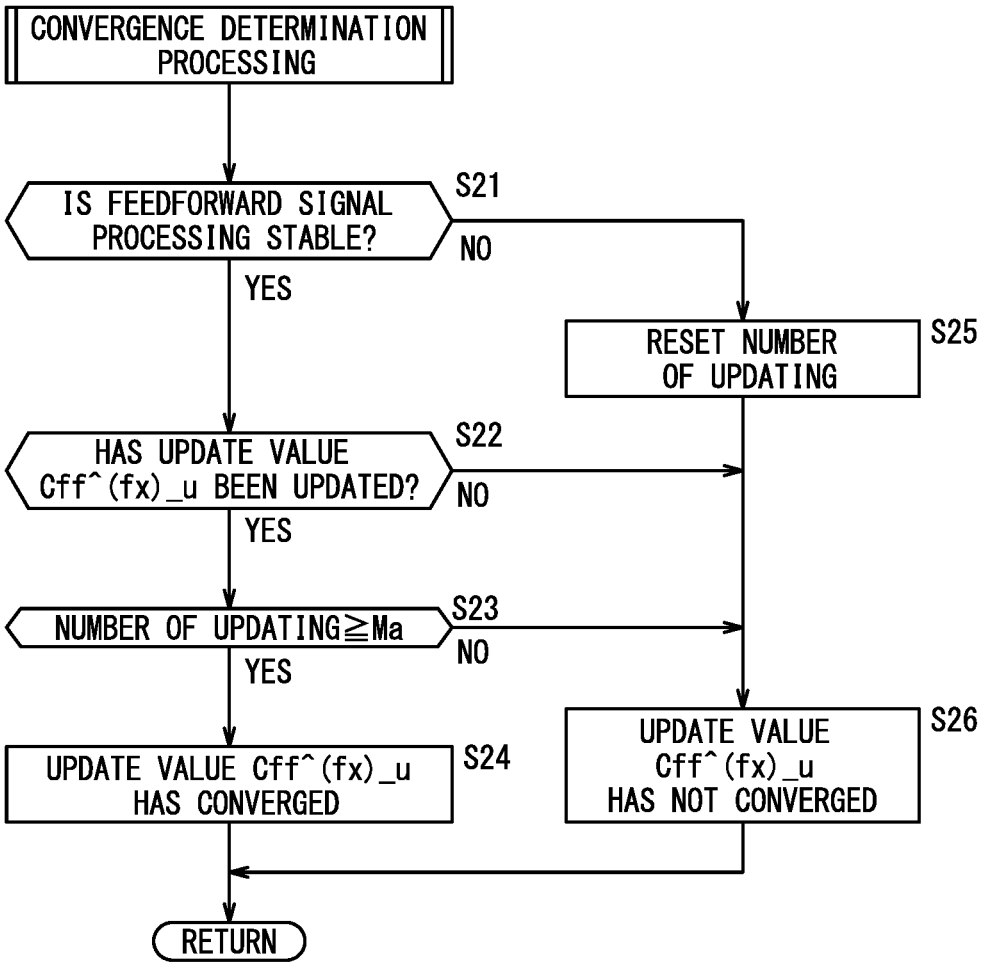
FIG. 11 is a flowchart illustrating a flow of convergence determination processing of an update value by the cooperative control unit.

FIG. 11 is a flowchart illustrating a flow of convergence determination processing of the update value Cff^^(fx)_u in the cooperative control unit 24.

In step S21, the cooperative control unit 24 determines the state of the feedforward signal processing. When the feedforward signal processing is stable, the process proceeds to step S22, and when the feedforward signal processing is unstable, the process proceeds to step S25.

The cooperative control unit 24 determines that the feedforward signal processing is stable when the magnitude |Cff^^·W| obtained by combining the secondary path filter Cff^^ and the control filter W is equal to or smaller than the magnitude |H^| of the primary path filter H^. On the other hand, when the magnitude Cff^^·W| is larger than the magnitude |H^|, the cooperative control unit 24 determines that the feedforward signal processing is unstable.

In step S22, the cooperative control unit 24 determines whether or not the update value Cff^^(fx)_u has been updated. When the update value Cff^^(fx)_u has been updated, the process proceeds to step S23, and when the update value Cff^^(fx)_u has not been updated, the process proceeds to step S26.

In step S23, the cooperative control unit 24 determines whether or not the number of updating of the update value Cff^^(fx)_u is equal to or greater than a predetermined number Ma. When the number of updating of the update value Cff^^(fx)_u is equal to or greater than the predetermined number Ma, the process proceeds to step S24, and when the number of updating of the update value Cff^^(fx)_u is less than the predetermined number Ma, the process proceeds to step S26.

In step S24, the cooperative control unit 24 determines that the update value Cff^^(fx)_u has converged and ends the convergence determination processing.

As described above, after it is determined that the feedforward signal processing is unstable in step S21, the process proceeds to step S25. In step S25, the cooperative control unit 24 resets the number of updating of the update value Cff^^(fx)_u, and proceeds to step S26.

After step S25 described above, the process proceeds to step S26. Also, as described above, when it is determined that the update value Cff^^(fx)_u is not updated in step S22, the process proceeds to step S26. Further, when it is determined in step S23 that the number of updating of the update value Cff^^(fx)_u is less than the predetermined number Ma, the process proceeds to step S26. In step S26, the cooperative control unit 24 determines that the update value Cff^^(fx)_u has not converged yet, and ends the convergence determination processing.

[Advantageous Effects]

The active noise control device 10 according to the present embodiment includes the cooperative control unit 24 that performs cooperative control between the muffled sound control signal processing unit 20 and the narrow band noise control signal processing unit 22. The cooperative control unit 24 causes the muffled sound control signal processing unit 20 to start the feedforward signal processing before causing the narrow band noise control signal processing unit 22 to start the feedback signal processing. In the following case, the cooperative control unit 24 sets the secondary path filter Cfb^ of the narrow band noise control signal processing unit 22 to be the secondary path filter Cff^^ corresponding to the control target frequency fx. This case is a case where the secondary path filter Cff^^ (=update value Cff^^(fx)_u) corresponding to the control target frequency fx has converged due to the updating of the secondary path filter Cff^^ by the secondary path filter updating unit 56 of the muffled sound control signal processing unit 20. After that, the cooperative control unit 24 causes the narrow band noise control signal processing unit 22 to start feedback signal processing.

As a result, the narrow band noise control signal processing unit 22 can start feedback signal processing using the secondary path filter Cff^^ for which learning has advanced in the feedforward processing that was started earlier. Therefore, in particular, it is possible to improve the sound pressure reduction performance for the drumming noise immediately after the start of the feedback signal processing. Further, it is possible to prevent the generation of abnormal sound from the speaker 18 immediately after the start of the feedback signal processing.

In addition, in the active noise control device 10 according to the present embodiment, when the cooperative control unit 24 determines that the feedforward signal processing is stable, the cooperative control unit 24 counts the number of updating of the secondary path filter Cff^^ corresponding to the control target frequency fx. When the counted number of updating is equal to or greater than a predetermined number, the cooperative control unit 24 determines that the secondary path filter Cff^^ corresponding to the control target frequency fx has converged.

Accordingly, the cooperative control unit 24 can accurately perform the convergence determination of the secondary path filter Cff^^ corresponding to the control target frequency fx.

Further, In addition, in the active noise control device 10 according to the present embodiment, when the cooperative control unit 24 determines that the feedforward signal processing is unstable, the cooperative control unit 24 resets the number of updating of the secondary path filter Cff^^ corresponding to the control target frequency fx.

When the feedforward signal processing becomes unstable, it is considered that the secondary path filter Cff^^ corresponding to the control target frequency fx has not been updated such that the filter converges. Therefore, by recounting the number of updating of the secondary path filter Cff^^ corresponding to the control target frequency fx, the cooperative control unit 24 can accurately perform the convergence determination of the secondary path filter Cff^^ corresponding to the control target frequency fx.

Second Embodiment

In an active noise control device 10 according to the present embodiment, a cooperative control unit 24 sets an initial value for the control filter V of the narrow band noise control signal processing unit 22 before starting the feedback signal processing. Before starting the feedback signal processing, the cooperative control unit 24 sets the secondary path filter C^ of the muffled sound control signal processing unit 20 to have a corrected value C_eq^ reflecting the influence of the FB control signal u0_*b*.

[Setting of Initial Value for Control Filter V]

A sensitivity function S, which is a transfer function of the error signal e and the noise d, is expressed by the following expression.

$$S = \frac{E}{D} = \frac{1}{1 + V \cdot C}$$

In the expression, E is a frequency characteristic of the error signal e, and D is a frequency characteristic of the noise d. When the secondary path filter Cfb^ is substituted for the transfer characteristic C of the secondary path, the control filter V is expressed by the following expression.

$$V = \frac{1 - S}{S} \cdot \frac{1}{Cfb\hat{}}$$

For example, when the acoustic pressure of drumming noise is reduced by approximately 6 dB, the sensitivity function S is approximately 0.5. In this case, the cooperative control unit 24 sets the initial value of the control filter V of the narrow band noise control signal processing unit 22 to be 1/Cfb^ and starts feedback signal processing.

[Setting of Correction Value C_eq^]

As shown in FIG. 3, from the viewpoint of the muffled sound control signal processing unit 20, the error signal e includes the influence of the FB control signal u0_*b*. Therefore, before starting the feedback signal processing, the cooperative control unit 24 obtains the correction value C_eq^ for the secondary path filter Cff^^ reflecting the influence of the FB control signal u0_*b*, and sets the update value Cff^^(fx)_u corresponding to the control target frequency fx in the update value table 28 to be the correction value C_eq^. The correction value C_eq^ is expressed by the following expression.

$$\text{C_eq}\hat{} = \frac{E}{\text{U0_a}} = \frac{\text{U0_a} \cdot C + \text{U0_b} \cdot C}{\text{U0_a}} = \frac{\text{U0_a} \cdot C + E \cdot V \cdot C}{\text{U0_a}}$$

Here, U0_*a* is a frequency characteristic of the FF control signal u0_*a*. When the secondary path filter Cfb^ is substituted for the transfer characteristic C of the secondary path, the correction value C_eq^ is expressed by the following expression.

$$C_eq\,\hat{} = \frac{Cfb\hat{}}{1 - V \cdot Cfb\hat{}}$$

After the feedback signal processing is started, the cooperative control unit 24 uses the correction value C_eq^ as an update value Cff^^(fx)_u corresponding to the control target frequency fx in the update value table 28. This update value Cff^^(fx)_u is used as the secondary path filter Cff^^ of the muffled sound control signal processing unit 20 when the vibration frequency f is fx. That is, it can be said that the secondary path filter Cff^^ is set to have the correction value C_eq^.

[Advantageous Effects]

In the active noise control device 10 according to the present embodiment, the cooperative control unit 24 obtains an initial value for the control filter V based on the secondary path filter Cfb^ before starting the feedback signal processing. The cooperative control unit 24 sets an initial value for the control filter V of the narrow band noise control signal processing unit 22. Further, the cooperative control unit 24 obtains a correction value C_eq^ for the secondary path filter Cff^^, based on the initial value of the control filter V and the secondary path filter Cfb^. Then, the correction value C_eq^ is used as an update value Cff^^(fx)_u corresponding to the control target frequency fx in the update value table 28.

This makes it possible to reflect the influence of the FB control signal u0_*b* in the secondary path filter C^ of the muffled sound control signal processing unit 20, thereby improving the sound pressure reducing performance for the engine muffled sound.

Third Embodiment

In the present embodiment, cooperative control processing performed by the cooperative control unit 24 is partially different from that of the first embodiment.

Figure 12:
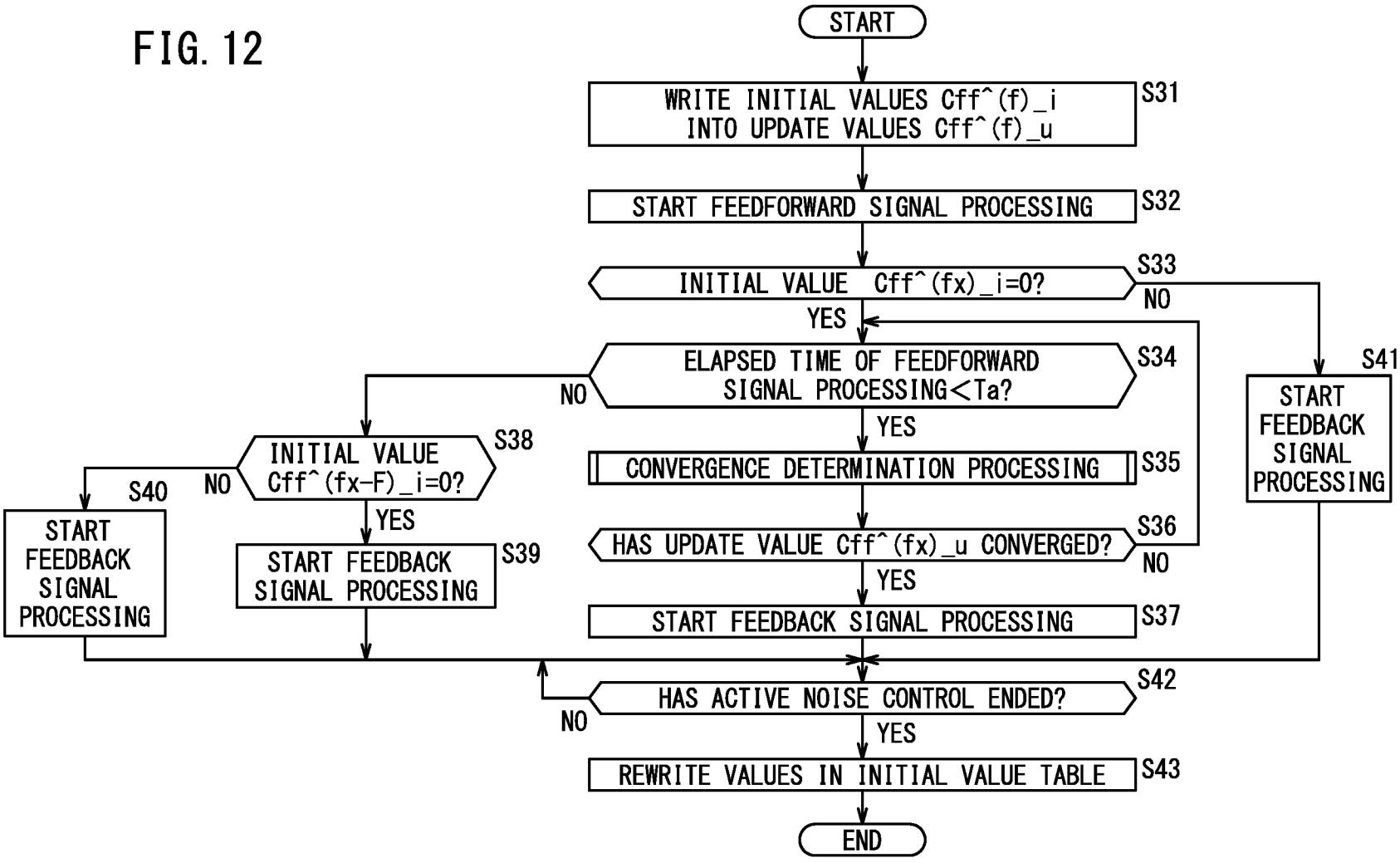
FIG. 12 is a flowchart illustrating a flow of cooperative control processing performed by the cooperative control unit.

FIG. 12 is a flowchart illustrating the flow of cooperative control processing performed by the cooperative control unit 24.

In step S31, the cooperative control unit 24 writes the initial values Cff^^(f)_i of the initial value table 26 into the update values Cff^^(f)_u of the update value table 28, and proceeds to step S32.

In step S32, the cooperative control unit 24 causes the muffled sound control signal processing unit 20 to start the feedforward signal processing, and the process proceeds to step S33.

In step S33, the cooperative control unit 24 determines whether or not the initial value Cff^^(fx)_i corresponding to the control target frequency fx is "0". When the initial value Cff^^(fx)_i is "0", the process proceeds to step S34, and when the initial value Cff^^(fx)_i is not "0", the process proceeds to step S41.

In step S34, the cooperative control unit 24 determines whether or not the elapsed time from the start of the feedforward signal processing is less than a predetermined time Ta. If the elapsed time is shorter than the predetermined time Ta, the process proceeds to step S35, and if the elapsed time is equal to or longer than the predetermined time Ta, the process proceeds to step S38.

In step S35, the cooperative control unit 24 performs convergence determination processing on the update value Cff^^(fx)_u corresponding to the control target frequency fx, and proceeds to step S36. The convergence determination processing is the same as that of the first embodiment.

In step S36, the cooperative control unit 24 determines whether or not the update value Cff^^(fx)_u has converged. When the update value Cff^^(fx)_u has converged, the process proceeds to step S37, and when the update value Cff^^(fx)_u has not converged, the process returns to step S34.

In step S37, the cooperative control unit 24 causes the narrow band noise control signal processing unit 22 to start the feedback signal processing, and the process proceeds to step S42. When the feedback signal processing is started in step S37, the secondary path filter Cfb^ of the narrow band noise control signal processing unit 22 is set to have the update value Cff^^(fx)_u of the update value table 28. At this time, the update value Cff^^(fx)_u has converged. As a result, the feedback signal processing can be started using the update value Cff^^(fx)_u that has been well subject to learning and converged, in the feedforward signal processing.

As described above, in step S34, when the elapsed time from the start of the feedforward signal processing is equal to or longer than the predetermined time Ta, the process proceeds to step S38.

In step S38, the cooperative control unit 24 determines whether or not the initial value Cff^^(fx−F)_i is "0". When the initial value Cff^^(fx−F)_i is "0", the process proceeds to step S39, and when the initial value Cff^^(fx−F)_i is not "0", the process proceeds to step S40. Here, F is set in advance to relatively small frequency such as 1 Hz or 2 Hz. That is, fx−F is a frequency in the vicinity of the control target frequency fx and lower than the control target frequency fx. The vibration frequency f changes in accordance with the engine rotational speed Ne. Since the engine 12 runs from a low rotational speed to a high rotational speed, when the initial value Cff^^(fx)_i is "0", there is a low possibility that the initial value Cff^^(f)_i corresponding to the vibration frequency f higher than the control target frequency fx is set to a value other than "0". Therefore, fx−F is set to a frequency lower than the control target frequency fx. Instead of setting F in advance, F may be dynamically set such that the initial value Cff^^(fx−F)_i is not "0" and fx−F is a frequency closest to the control target frequency fx.

In step S39, the cooperative control unit 24 causes the narrow band noise control signal processing unit 22 to start the feedback signal processing, and the process proceeds to step S42. When the feedback signal processing is started in step S39, the secondary path filter Cfb^ of the narrow band noise control signal processing unit 22 is set to have the update value Cff^^(fx)_u of the update value table 28. At this time, the update value Cff^^(fx)_u has not converged yet. As a result, when the elapsed time from the start of the feedforward signal processing becomes equal to or longer than the predetermined time Ta, the feedback signal processing is started even if the update value Cff^^(fx)_u has not converged, and thus it is possible to reduce the sound pressure of the drumming noise.

In step S40, the cooperative control unit 24 causes the narrow band noise control signal processing unit 22 to start the feedback signal processing, and the process proceeds to step S42. When the feedback signal processing is started in step S40, the secondary path filter Cfb^ of the narrow band noise control signal processing unit 22 is set to have the initial value Cff^(fx−F)_i of the initial value table 26. Accordingly, since the secondary path filter Cfb^ is set to have the initial value Cff^(fx−F)_i relatively close to the transfer characteristic C of the secondary path, it is possible to reduce the sound pressure of the drumming noise.

As described above, if the initial value Cff^(fx)_i is not "0" in step S33, the process proceeds to step S41.

In step S41, the cooperative control unit 24 causes the narrow band noise control signal processing unit 22 to start the feedback signal processing, and the process proceeds to step S42. When the feedback signal processing is started in step S41, the secondary path filter Cfb^ of the narrow band noise control signal processing unit 22 is set to the initial value Cff^(fx)_i of the initial value table 26.

In step S42, the cooperative control unit 24 determines whether or not the active noise control has ended. When the active noise control has ended, the process proceeds to step S43, and when the active noise control has not ended, the process of step S42 is repeated.

In step S43, the cooperative control unit 24 rewrites the initial values Cff^(f)_i stored in the initial value table 26 to be the update values Cff^(f)_u stored in the update value table 28, and ends the cooperation control process. However, for the initial value Cff^(fx)_i of the initial value table 26, the latest secondary path filter Cfb^ updated by the secondary path filter updating unit 84 of the narrow band noise control signal processing unit 22 is written over.

[Advantageous Effects]

In a case where the vehicle continues traveling in a state where the engine rotational speed Ne is low, when the vibration frequency f does not reach fx, learning of the update value Cff^(fx)_u does not progress, and the update value Cff^(fx)_u may not converge.

In the active noise control device 10 of the present embodiment, when the update value Cff^(fx)_u does not converge even if the elapsed time from the start of the feedforward signal processing by the muffled sound control signal processing unit 20 becomes equal to or longer than the predetermined time Ta, the feedback signal processing is started by the narrow band noise control signal processing unit 22. Thus, it is possible to prevent a situation from continuing for a long time, in which the sound pressure of the drumming noise is not reduced.

Further, in the active noise control device 10 of the present embodiment, when the initial value Cff (fx)_i is 0, the feedback signal processing by the narrow band noise control signal processing unit 22 is started using the initial value Cff^(fx−F)_i corresponding to the frequency fx−F around the control target frequency fx. The actual transfer characteristic C of the secondary path continuously changes with respect to a change in the frequency of the canceling sound output from the speaker 18. Therefore, the difference is small, between the transfer characteristic C for the control target frequency fx and the transfer characteristic C for the frequency fx−F. Since the feedback signal processing is performed using, as the secondary path filter C, the initial value Cff^(fx−F)_i in which learning is advanced instead of the initial value Cff^(fx)_i in which learning is not advanced, it is possible to improve the sound pressure reduction performance for the drumming noise particularly immediately after the start of the feedback signal processing. Further, it is possible to suppress the generation of abnormal sound from the speaker 18 immediately after starting the feedback signal processing.

[Technical Concepts Obtained From Embodiments]

A description will be given below concerning technical concepts that are capable of being grasped from the above-described embodiments.

The active noise control device (10) performs active noise control for controlling the speaker (18) based on an error signal output from the detector (32) that detects, at a control point, a synthetic sound of noise transmitted from a vibration source and a canceling sound output from the speaker to cancel the noise, and the active noise control device includes the feedforward signal processing unit (20) configured to perform feedforward signal processing for outputting a feedforward control signal in order to control the speaker based on a vibration frequency of the vibration source, the feedback signal processing unit (22) configured to perform feedback signal processing for outputting a feedback control signal in order to control the speaker based on a component of the error signal in a frequency band centered on a predetermined frequency, and the cooperative control unit (24) configured to perform cooperative control between the feedforward signal processing unit and the feedback signal processing unit, wherein the feedforward signal processing unit includes the feedforward secondary path filter updating unit (56) configured to update sequentially and adaptively a feedforward secondary path filter that is a filter related to a sound transfer characteristic from the speaker to the detector, wherein the feedback signal processing unit includes the feedback secondary path filter signal processing unit (72) configured to perform signal processing using a feedback secondary path filter that is a filter related to the sound transfer characteristic from the speaker to the detector, and wherein the cooperative control unit is configured to cause the feedforward signal processing unit to start the feedforward signal processing, and set, when the feedforward secondary path filter has converged, the feedback secondary path filter to the converged feedforward secondary path filter, and cause the feedback signal processing unit to start the feedback signal processing.

In the active noise control device, the feedforward signal processing unit may include the basic signal generating unit (38) configured to generate a basic signal in accordance with the vibration frequency, the feedforward control signal generating unit (40) configured to perform signal processing on the basic signal by a feedforward control filter, which is an adaptive notch filter, to generate the feedforward control signal, the feedforward reference signal generating unit (44) configured to perform signal processing on the basic signal by a feedforward secondary path filter, which is an adaptive notch filter, to generate a feedforward reference signal, the feedforward secondary path filter updating unit configured to update sequentially and adaptively the feedforward secondary path filter based on the error signal and the feedforward control signal in a manner that a magnitude of the error signal is minimized, and the feedforward control filter updating unit (58) configured to update sequentially and adaptively the feedforward control filter based on the error signal and the feedforward reference signal in a manner that the magnitude of the error signal is minimized, and the feedback signal processing unit may include, the extraction signal generating unit (92) configured to extract the component of the error signal in the frequency band centered on the predetermined frequency to generate an extraction signal, the feedback control signal generating unit (68) configured to perform signal processing on the extraction signal by a feedback control filter, which is an adaptive notch filter, to generate a feedback control signal, the feedback secondary path filter signal processing unit configured to perform the signal processing on the extraction signal by the feedback secondary path filter, which is an adaptive notch filter, to generate a feedback reference signal, and the feedback control filter updating unit (86) configured to update sequentially and adaptively the feedback control filter based on the error signal and the feedback reference signal in a manner that the magnitude of the error signal is minimized.

In the active noise control device, the cooperative control unit may be configured to determine whether the feedforward signal processing is stable, count a number of updating of the feedforward secondary path filter when the feedforward signal processing is stable, and determine that the feedforward secondary path filter has converged when the number of updating is equal to or greater than a predetermined number.

In the active noise control device, the cooperative control unit may be configured to reset the counted number of updating when the feedforward signal processing is unstable.

In the active noise control device, before starting the feedback signal processing by the feedback signal processing unit, the cooperative control unit may be configured to obtain an initial value for the feedback control filter based on the converged feedforward secondary path filter, and set the feedback control filter of the feedback signal processing unit to have the initial value for the feedback control filter.

In the active noise control device, before starting the feedback signal processing by the feedback signal processing unit, the cooperative control unit may be configured to obtain a correction value for the feedforward secondary path filter based on the converged feedforward secondary path filter and the initial value for the feedback control filter, and set the feedforward secondary path filter of the feedforward signal processing unit to have the correction value.

The active noise control device may further include the initial value table (26) that stores initial values for the feedforward secondary path filter in table form in association with frequencies, and the update value table (28) that stores update values for the feedforward secondary path filter in table form in association with frequencies, and the feedback signal processing unit may include the feedback secondary path filter updating unit (84) configured to update sequentially and adaptively the feedback secondary path filter based on the error signal and the feedback control signal in a manner that a magnitude of the error signal is minimized, and the cooperative control unit may be configured to write an initial value for the feedforward secondary path filter in the initial value table into the update value table as an update value for the feedforward secondary path filter when the active noise control is started, write the updated feedforward secondary path filter into the update value table as the update value for the feedforward secondary path filter corresponding to the vibration frequency each time the feedforward secondary path filter is updated by the feedforward secondary path filter updating unit during the active noise control, and write the update value for the feedforward secondary path filter in the update value table into the initial value table as the initial value for the feedforward secondary path filter and write the feedback secondary path filter into the initial value table as the initial value for the feedforward secondary path filter corresponding to the predetermined frequency, when the active noise control is ended.

The active noise control device may further includes the initial value table configured to store initial values for the feedforward secondary path filter in table form in association with frequencies, and the cooperative control unit may be configured to set, when an initial value for the feedforward secondary path filter corresponding to the predetermined frequency is not 0, the feedback secondary path filter to have the initial value for the feedforward secondary path filter and cause the feedback signal processing unit to start the feedback signal processing, and set, when an initial value for the feedforward secondary path filter corresponding to the predetermined frequency is 0, the feedback secondary path filter to have an initial value for the feedforward secondary path filter corresponding to the vibration frequency lower than the predetermined frequency and cause the feedback signal processing unit to start the feedback signal processing.

The present invention is not particularly limited to the embodiments described above, and various modifications are possible without departing from the essence and gist of the present invention.

What is claimed is:

1. An active noise control device that performs active noise control for controlling a speaker based on an error signal output from a detector that detects, at a control point, a synthetic sound of noise transmitted from a vibration source and a canceling sound output from the speaker to cancel the noise, the active noise control device comprising one or more processors that execute computer-executable instructions stored in a memory, wherein the one or more processors execute the computer-executable instructions to cause the active noise control device to:

perform feedforward signal processing for outputting a feedforward control signal in order to control the speaker based on a vibration frequency of the vibration source;

perform feedback signal processing for outputting a feedback control signal in order to control the speaker based on a component of the error signal in a frequency band centered on a predetermined frequency;

perform cooperative control processing between the feedforward signal processing and the feedback signal processing, wherein the feedforward signal processing updates sequentially and adaptively a feedforward secondary path filter that is a filter related to a sound transfer characteristic from the speaker to the detector, wherein the feedback signal processing performs signal processing using a feedback secondary path filter that is a filter related to the sound transfer characteristic from the speaker to the detector, and wherein the cooperative control processing:

starts the feedforward signal processing; and sets, when the feedforward secondary path filter has converged, the feedback secondary path filter to the converged feedforward secondary path filter, and starts the feedback signal processing.

2. The active noise control device according to claim 1, wherein in the feedforward signal processing, the one or more processors cause the active noise control device to:

generate a basic signal in accordance with the vibration frequency;

perform signal processing on the basic signal by a feedforward control filter, which is an adaptive notch filter, to generate the feedforward control signal;

perform signal processing on the basic signal by a feedforward secondary path filter, which is an adaptive notch filter, to generate a feedforward reference signal;

update sequentially and adaptively the feedforward secondary path filter based on the error signal and the feedforward control signal in a manner that a magnitude of the error signal is minimized;

update sequentially and adaptively the feedforward control filter based on the error signal and the feedforward reference signal in a manner that the magnitude of the error signal is minimized; and wherein in the feedback signal processing, the one or more processors cause the active noise control device to:

extract the component of the error signal in the frequency band centered on the predetermined frequency to generate an extraction signal;

perform signal processing on the extraction signal by a feedback control filter, which is an adaptive notch filter, to generate a feedback control signal;

perform the signal processing on the extraction signal by the feedback secondary path filter, which is an adaptive notch filter, to generate a feedback reference signal; and update sequentially and adaptively the feedback control filter based on the error signal and the feedback reference signal in a manner that the magnitude of the error signal is minimized.

3. The active noise control device according to claim 1, wherein in the cooperative control processing, the one or more processors cause the active noise control device to:

determine whether the feedforward signal processing is stable;

count a number of updating of the feedforward secondary path filter when the feedforward signal processing is stable; and determine that the feedforward secondary path filter has converged when the number of updating is equal to or greater than a predetermined number.

4. The active noise control device according to claim 3, wherein in the cooperative control processing, the one or more processors cause the active noise control device to reset the counted number of updating when the feedforward signal processing is unstable.

5. The active noise control device according to claim 1, wherein in the cooperative control processing, before starting the feedback signal processing, the one or more processors cause the active noise control device to obtain an initial value for the feedback control filter based on the converged feedforward secondary path filter, and set the feedback control filter to have the initial value.

6. The active noise control device according to claim 5, wherein in the cooperative control processing, before starting the feedback signal processing, the one or more processors cause the active noise control device to obtain a correction value for the feedforward secondary path filter based on the converged feedforward secondary path filter and the initial value for the feedback control filter, and set the feedforward secondary path filter to have the correction value.

7. The active noise control device according to claim 1, further comprising:

an initial value table that stores initial values for the feedforward secondary path filter in table form in association with frequencies; and an update value table that stores update values for the feedforward secondary path filter in table form in association with frequencies, wherein in the feedback signal processing, the one or more processors cause the active noise control device to update sequentially and adaptively the feedback secondary path filter based on the error signal and the feedback control signal in a manner that a magnitude of the error signal is minimized, and wherein in the cooperative control processing, the one or more processors cause the active noise control device to:

write an initial value for the feedforward secondary path filter in the initial value table into the update value table as an update value for the feedforward secondary path filter when the active noise control is started;

write the updated feedforward secondary path filter into the update value table as the update value for the feedforward secondary path filter corresponding to the vibration frequency each time the feedforward secondary path filter is updated during the active noise control; and write the update value for the feedforward secondary path filter in the update value table into the initial value table as the initial value for the feedforward secondary path filter and write the feedback secondary path filter into the initial value table as the initial value for the feedforward secondary path filter corresponding to the predetermined frequency, when the active noise control is ended.

8. The active noise control device according to claim 1, further comprising an initial value table configured to store initial values for the feedforward secondary path filter in table form in association with frequencies, wherein in the cooperative control processing, the one or more processors cause the active noise control device to:

set, when an initial value for the feedforward secondary path filter corresponding to the predetermined frequency is not 0, the feedback secondary path filter to have the initial value for the feedforward secondary path filter and start the feedback signal processing; and set, when an initial value for the feedforward secondary path filter corresponding to the predetermined frequency is 0, the feedback secondary path filter to have an initial value for the feedforward secondary path filter corresponding to the vibration frequency lower than the predetermined frequency and start the feedback signal processing.

* * * * *